US011606983B2

(12) United States Patent
Hastings

(10) Patent No.: US 11,606,983 B2
(45) Date of Patent: Mar. 21, 2023

(54) DETACHABLE T-SHIRT COLLAR

(71) Applicant: Paul Hastings, Oakville (CA)

(72) Inventor: Paul Hastings, Oakville (CA)

( * ) Notice: Subject to any disclaimer, the term of this patent is extended or adjusted under 35 U.S.C. 154(b) by 194 days.

(21) Appl. No.: 15/838,291

(22) Filed: Dec. 11, 2017

(65) Prior Publication Data

US 2019/0059451 A1 Feb. 28, 2019

(30) Foreign Application Priority Data

Aug. 23, 2017 (CA) ..... 2977144

(51) Int. Cl.

| | |
|---|---|
| ***A41B 3/04*** | (2006.01) |
| ***A41D 5/00*** | (2006.01) |
| ***A41B 5/00*** | (2006.01) |
| ***A41F 1/00*** | (2006.01) |
| *A41B 3/10* | (2006.01) |

(52) U.S. Cl.

CPC ..... *A41B 3/04* (2013.01); *A41B 5/00* (2013.01); *A41F 1/00* (2013.01); *A41F 1/002* (2013.01); *A41B 3/10* (2013.01)

(58) Field of Classification Search

CPC .... A41B 3/04; A41B 3/14; A41B 1/12; A41B 3/00; A41B 5/00; A41B 3/005; A41B 3/06; A41B 3/08; A41B 3/12; A41B 3/16; A41B 3/18; A41B 7/04; A41B 7/12; A41B 7/06; A41B 7/10; A41B 2300/24; A41B 1/14; A41B 1/16; A41B 3/10; A41B 9/06; A41D 27/16; A41D 27/18; A41D 27/08; A41F 1/00; A41F 1/002

USPC ..... 2/116, 139

See application file for complete search history.

(56) References Cited

U.S. PATENT DOCUMENTS

| | | | | | |
|---|---|---|---|---|---|
| 1,563,274 | A * | 11/1925 | Furman | A41B 3/14 | 2/127 |
| 1,637,540 | A * | 8/1927 | Sukrow | A41B 3/14 | 2/131 |
| 2,125,033 | A * | 7/1938 | Shepherd | A41B 3/04 | 2/139 |
| 2,164,751 | A * | 7/1939 | Newman | A41B 3/04 | 2/139 |
| 2,182,486 | A * | 12/1939 | Broder | A41B 3/04 | 2/139 |
| 2,451,364 | A * | 10/1948 | Spector | A41B 3/14 | 2/139 |

(Continued)

FOREIGN PATENT DOCUMENTS

| | | | | | |
|---|---|---|---|---|---|
| GB | 265520 | A * | 2/1927 | A41B 3/14 | |
| GB | 524100 | A * | 7/1940 | A41B 3/04 | |

(Continued)

*Primary Examiner* — Amy Vanatta

(57) ABSTRACT

In this invention, the detachable T-shirt collar, DTSC, is for a regular T-shirt without any provision for a detachable collar. This invented collar is attached through or close to the stretchable T-shirt collar band at the neck to transform a regular T-shirt, old or new, into a more formal attire. The collar attachment is for the standard O-neck and V-neck and the stretchable T-shirt material is compatible with the collar material. The fastening method can use various methods such as a pin, paired magnets, paired male and female clip connectors and tension clips that open and close, all of which can be made from a variety of materials such as metal or plastic.

3 Claims, 5 Drawing Sheets

(56) References Cited

U.S. PATENT DOCUMENTS 2,655,661 A * 10/1953 Persin ..... A41B 3/04 2/140
2,668,295 A * 2/1954 Garrido ..... A41B 3/00 2/132
2,725,568 A * 12/1955 Honigsberg ..... A41B 3/04 2/139
2,750,595 A * 6/1956 Hollinger ..... A41B 9/06 2/113
2,903,703 A * 9/1959 Blish ..... A41B 3/12 2/137
2,997,718 A * 8/1961 Jacobs ..... A41D 27/18 2/139
3,860,967 A * 1/1975 Tedesco ..... A41B 3/00 2/129
5,628,064 A * 5/1997 Chung ..... A41D 15/00 2/119
7,086,092 B1 * 8/2006 Cruz ..... A41B 3/04 2/132
7,770,236 B2 * 8/2010 Gulisano ..... A41D 27/18 2/116
2008/0276347 A1 * 11/2008 Alfin ..... A41B 3/12 2/129
2009/0222970 A1 * 9/2009 Coleman ..... A41B 1/22 2/108
2015/0106995 A1 * 4/2015 Ampofo ..... A41B 1/22 2/119
2016/0135508 A1 * 5/2016 Lawrence ..... A41B 3/18 2/129
2016/0302489 A1 * 10/2016 Grayson ..... A41B 3/04

FOREIGN PATENT DOCUMENTS

GB 761939 A * 11/1956 ..... A41B 3/04
GB 779409 A * 7/1957 ..... A41B 3/04

* cited by examiner

DETACHABLE T-SHIRT COLLAR

CROSS-REFERENCE TO RELATED APPLICATIONS

This application claims priority from Canadian Patent Application No. 2,977.144, titled DETACHABLE T-SHIRT COLLAR, filed on Aug. 23, 2017, filed on behalf of the same inventor and applicant below. The entire content of Canadian Patent Application No. 2,977,144 is incorporated by reference herein in its entirety.

TECHNICAL FIELD

This invention relates to a detachable T-shirt collar for a typical common T-shirt also referenced as a collarless garment where the collar can be attached and reattached very quickly without damaging the T-shirt.

BACKGROUND

In the clothing industry, it is known to have detachable collars for shirts as far back as the 1880's. Since then there have been detachable hoodies, detachable raingear and other detachable accessories, where the attachment tabs or buttons or fasteners were integral with the shirt or the shirt already had a provision for attachment of a collar, similar to what some pastors/clergy wear. In this invention, the detachable T-shirt collar, DTSC, is for a regular T-shirt without any provision for a detachable collar. This invented collar is attached through or close to the stretchable T-shirt collar band at the neck to transform a regular T-shirt, old or new, into a more formal attire.

In the garment manufacturing industry, T-Shirts are made without collars from stretchable fabric and the process of making a T-shirt is becoming highly automated to produce massive volumes of T-shirts worldwide as a distinct type of unisex garment, separate and apart from shirts made with fabrics that do not stretch and do not have a collar and for which prior art exists for collars to suit those types of shirts.

T-shirts started out as undergarments as early as 1898 where the US Navy used them as undergarments but have now become general-use unisex clothing where they are form fitting and slipover the head to be put on or taken off as outer-wear. Current detachable collars do not address the pliable and stretchable nature of T-shirts where if the collars do not stretch, they will trap the user in the T-shirt when attempts to remove the shirt over the head occurs, as the attachment methods can be very strong and not expand sufficiently for the head to pass through easily. As well, current collars that do not stretch require a T-shirt to then have the collar attached or detached only when the T-shirt is being worn. It allows removal of or putting on the T-shirt when the collar is attached and is a safe and major increase in flexibility usage for and by all ages.

T-shirts are a separate genre of shirts where the fabric used in making T-shirts is defined as stretchable where the material expands to be enlarged limier an applied force. It is common for T-shirts to be of different colors where they are used for casual settings and the cost of collarless T-shirts are very cheap in comparison to shirts with collars.

SUMMARY OF THE INVENTION

Sport activities or informal work activities where T-shirts are worn by a variety of age groups can have the T-shirt transformed with a simple collar addition or collar change that is both economical and fashionable. This improvement of a detachable T-shirt collar, DTSC, a device, allows a wider group of persons the choice for fashion upgrade on a limited budget. It maintains the features of the collars being of various fabrics but with the noted improvement of the fastening device concealer) by the exterior face of the detachable T-shirt collar, DTSC, whereupon an additional fold in the collar itself of the DISC further makes the detachable collar integral with the T-shirt and virtually indistinguishable as an add-on to the T-shirt itself.

Known features are maintained where the collar is separately washable, detachable and fashionable and is for males and females in keeping with the unisex nature of T-shirt use. Other maintained features ae the exterior face being articulated to invent new fashion statement designs, independent of the attachment surfaces to the T-shirt neck band, with colors used for specific recognition of a group or company. The "belt loop-type" feature which comprises a vertical elongated strip attached at intervals to the exterior exposed rear face of the collar allows a color choice or a message strip to be inserted separately on the outer surface of the collar. The cloth fabric when stitched in production at the fold lines to the adjacent face of the collar, maintains the shape of the collar when it is attached. The connection uses a mechanical fastening where a pin with an expanded horizontal face that is perpendicular to the pin is used to coordinate with a connecting cover that secures the pin end with friction when it clamps onto the pin end to secure it and where it can be released by pulling apart the two pieces to separate the pair to repeatedly to allow connecting and reconnecting of the matched pair. Magnets connect similarly.

BRIEF DESCRIPTION OF THE DRAWINGS

In drawings which illustrate embodiments of the invention of the Detachable T-Shirt Collar (hereinafter referred toas "DTSC")

Figure 1:
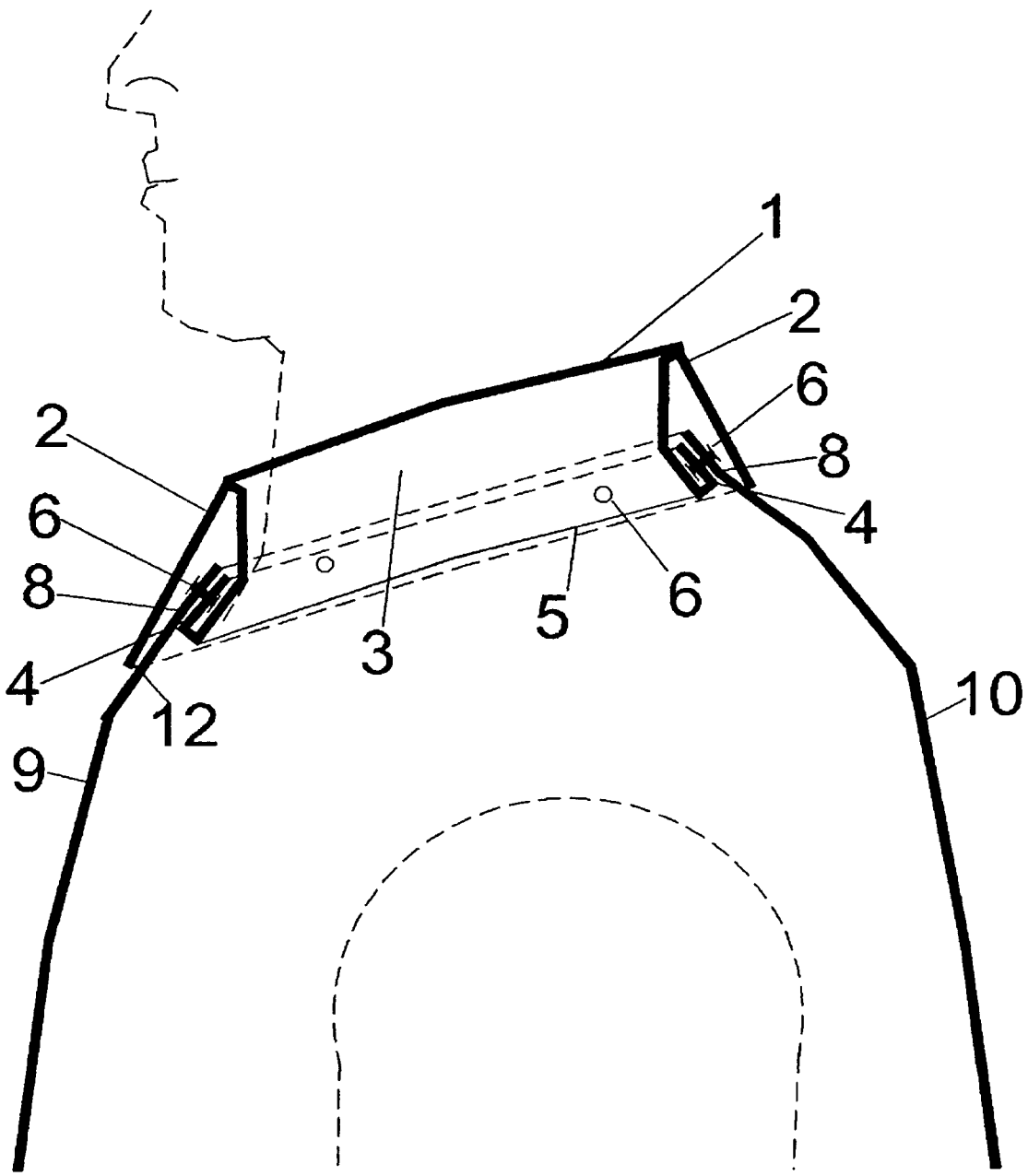
FIG. 1 illustrates a vertical section view through the T-shirt neck band and collar.

The following LEGEND indicates the corresponding items referenced in the drawings:

1. Top edge fold of DTSC (first fold line)
2. Exterior Face of DTSC (first panel)
3. Interior DTSC Face (second panel)
4. Upturn DTSC Fold (third panel)
5. Bottom Edge fold of Interior DTSC (second fold line)
6. DTSC Removable Collar Pin
6*a*. Magnet
7. Stitching as Required
8. T-Shirt Neck band
9. T-Shirt Front
10. T-Shirt Back
11. Downturn DTSC Fold (fourth panel)
12. Front Bottom Edge of DTSC

SPECIFICATION—DETAILED DESCRIPTION

The Detachable T-shirt Collar, DTSC, as illustrated in FIGS. 9, 10, 13, and 14 is comprised of fabric material that is made to a length as shown in FIGS. 3, 6 and 17, 20 to provide a gap at the front of the T-shirt dependent on the circumference of the T-shirt's neck band. Part 2 forming the Detachable T-shirt Collar, DTSC, where it is to be folded along the line indicated as part 1, 5 and 13 to have the top portion indicated as part 2 for the exterior face where it is the horizontal feature elongated panel indicated as part 2 throughout and as shown in the figures such as FIGS. 1, 2, 3, 4, 5, 6, 7, 9, 10, 13, 14, and is sized to match the T-shirt neck band.

The collar design is manifest as a 3 fold and 4 fold elongate complete fabrication where i) the collar has multiple folds to form the upper and lower portion and with the upper portion extending to form a fold to be the exterior face of the collar. The upper portion is the exterior face of the Detachable T-shirt Collar, forming a collar leaf, represented by first panel 2 in the illustrations, having its bottom edge in assembly indicated as part 12. The lower portion which starts below part 2 at the fold indicated as part 1, forms an interior face second panel 3. The collar, which may include stitching 7, is manifest as a 2 fold and 3 fold elongated continuity where the innermost portion of the fold is adjacent to the neck of the wearer and separates the connector from the wearer's neck. The innermost upturn fold 4 forms a third panel. The outer fold of the 2 fold lower portion allows the elongated fold to connect to the inner face of the T-shirt neck band which is indicated as part 8 throughout the illustrated figures. The additional fold of the 3 fold lower portion aligns around the neck band of the T-shirt collar and straddles neck band indicated as part 8 and which encircles the T-shirt from front indicated as part 9, to back indicated as part 10. The upper portion straddles the entire assembly over part 8 as a folded portion where it results in being virtually indistinguishable as a detachable attachment. The connectors indicated as part 6, pass through the outer fold 4 of the portion of the 2 fold lower portion and the T-shirt neck band.

Figure 3:
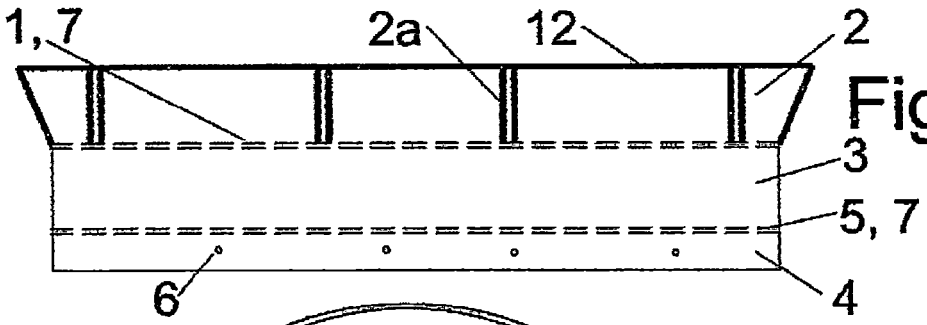
FIG. 3 illustrates an elevation view of FIG. 2, where it is laid out flat.
Figure 4:
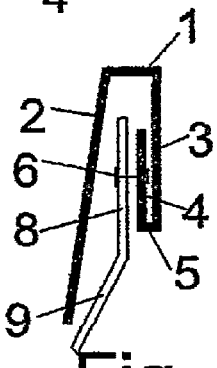
FIG. 4 illustrates a vertical section view through the front of the T-shirt with the folds as indicated for FIG. 2.
Figure 6:
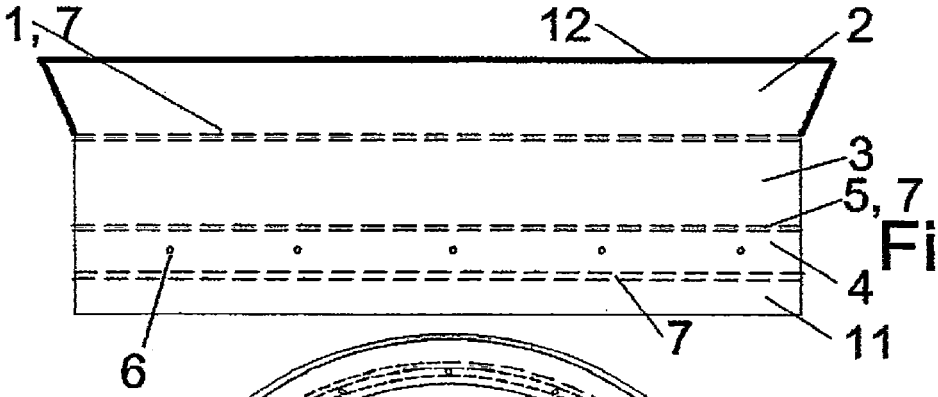
FIG. 6 illustrates the elevation view for FIG. 5 where it is laid out flat with other folds shown.
Figure 7:
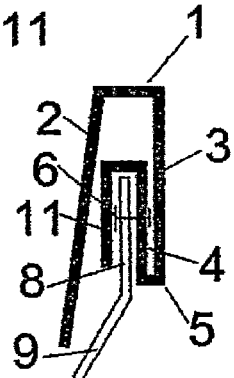
FIG. 7 illustrates the corresponding section view through FIG. 5.

In use, the connectors are covered from external view by the upper portion when it is folded over and straddles the T-shirt neck band and by the outermost fold of the lower 3 fold portion. In the mechanical attachment method, the 2-part fasteners are passing through the T-shirt neck band 8 to the DTSC as shown by part 6 on FIGS. 1, 2, 3, 4, 5, 6 and 7 and with the 2-part fastener not coming in contact with the wearer's skin to avoid any reaction with the wearer's skin. Both parts of the 2-part fastener assembly, when straddling the T-shirt neck band, are flat and grip each other for assembly and disassembly by mechanical force applied by the fingers for pulling them apart. The fasteners numbering between 3 and 9 are concealed as shown in FIGS. 1, 4 and 7. The outer face indicated as part 2 has a space between itself and part 8, except when part 11 is the next adjacent surface as indicated in FIG. 7 as is typical of regular shirts with a regular elongated collar. Magnets 6*a* connect similarly. The head of the fasteners 6 are interposed between the second panel 3 and the third panel 4 and pierces through the neckband 8 to the other panel. The fastener is a connection using a pin with an expanded face that is perpendicular to the pin and is used to coordinate with a connecting cover that secures the pin end with friction when it grips the pin end to secure it and where it can be released to allow connecting and reconnecting of the matched pair.

Figure 2:
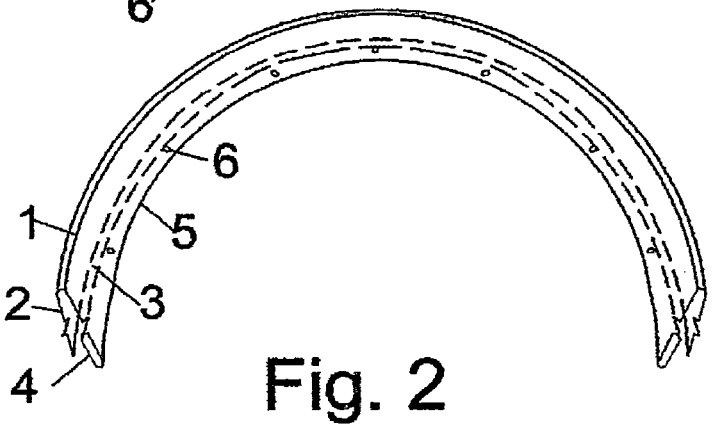
FIG. 2 illustrates a 3D folded view.
Figure 5:
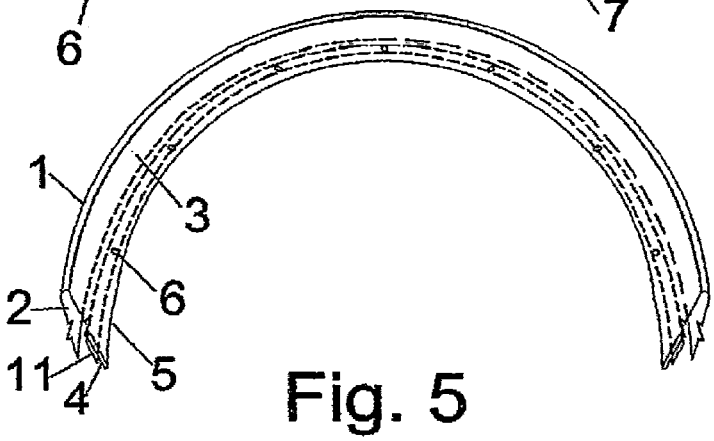
FIG. 5 illustrates another 3D folded view.
Figure 9:
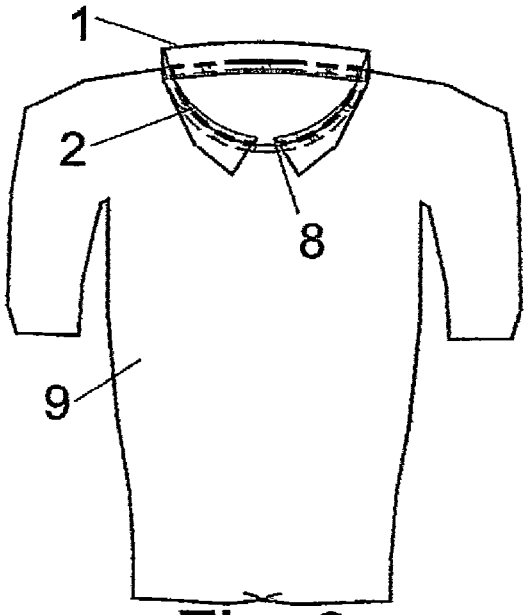
FIG. 9 illustrates a front view of a T-shirt with a Detachable T-shirt Collar, DTSC
Figure 10:
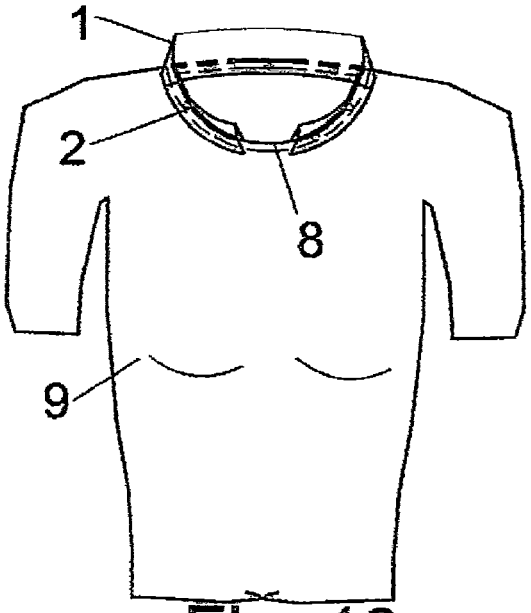
FIG. 10 illustrates a front view of a T-shirt with a modified Detachable T-shirt Collar. DTSC, where the ends come together.
Figure 8:
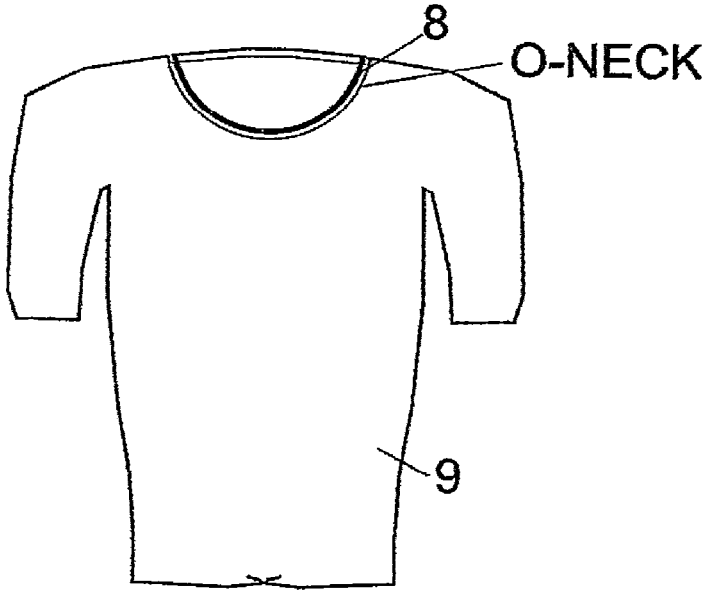
FIG. 8 illustrates a front view of an O-neck T-shirt without a Detachable T-shirt Collar, DTSC.
Figure 11:
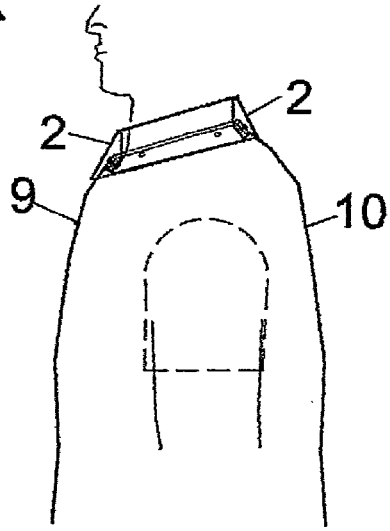
FIG. 11 illustrates a vertical section view showing relationship between collar and T-shirt wearer.
Figure 13:
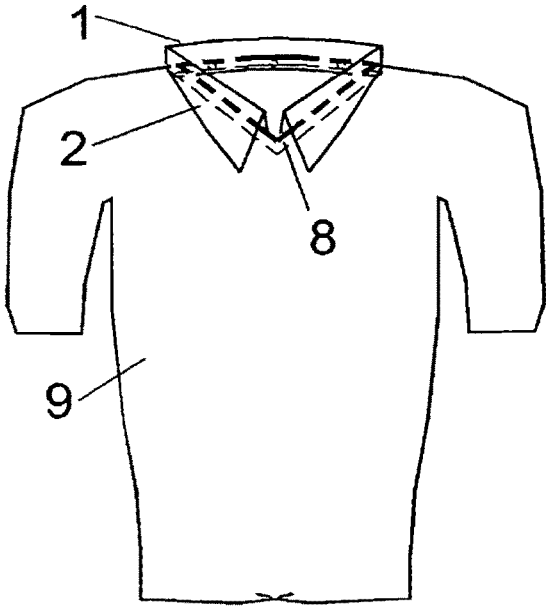
FIG. 13 illustrates a V-neck T-shirt with a Detachable T-shirt Collar, DTSC.
Figure 14:
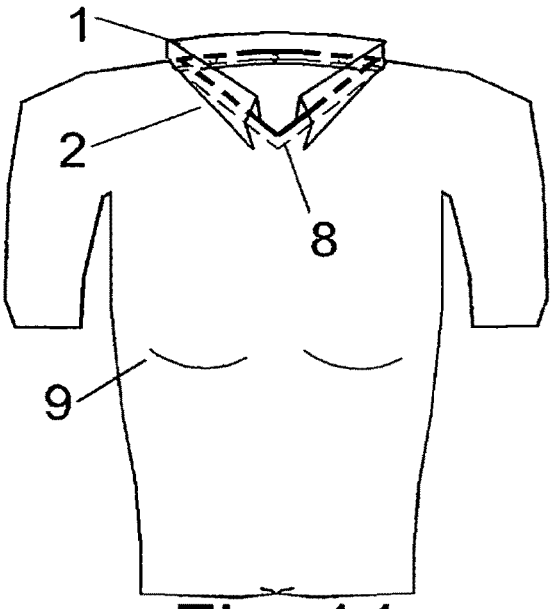
FIG. 14 illustrates a front view of a T-shirt with a modified Detachable T-shirt Collar, DTSC, where the ends come together.
Figure 12:
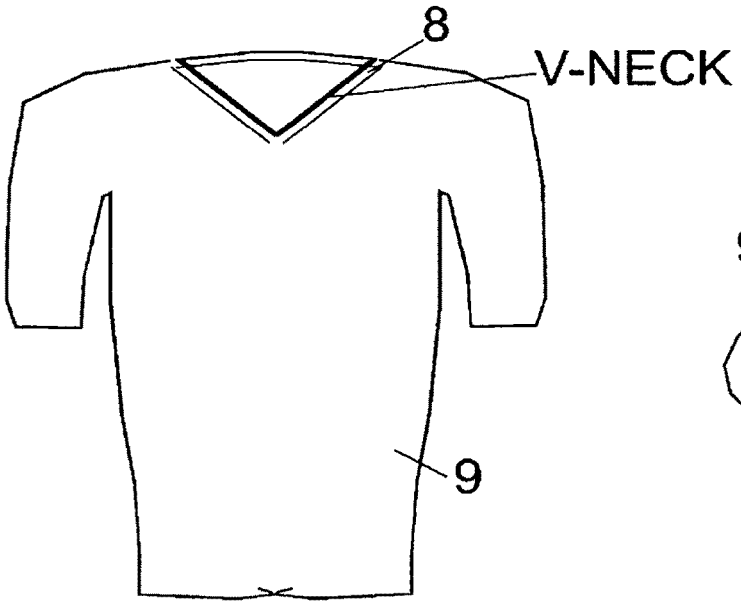
FIG. 12 illustrates the V-neck T-shirt without a Detachable T-shirt Collar, DTSC.
Figure 15:
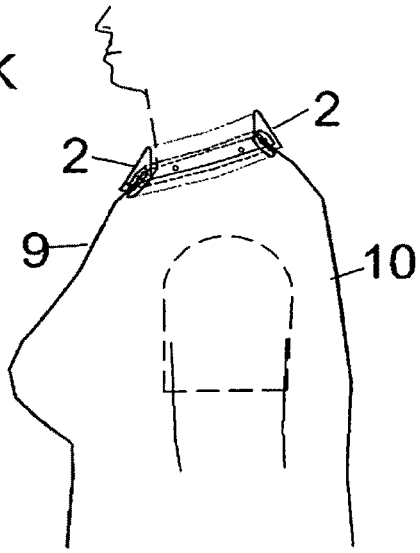
FIG. 15 illustrates a vertical section view showing relationship between collar and T-shirt wearer.

In drawings which illustrate embodiments of the invention, FIGS. 1, 4, 7 are sectional views that show the attachment relationship of the detachable T-shirt collar to the T-shirt collar band that goes around the neck of the individual. FIGS. 3 and 6 show the flattened strip that is folded to form the sectional views mentioned above to become a 2 fold or 3 fold DTSC type. FIGS. 2 and 5 are a 3D representation of the DTSC types. FIGS. 8 and 9 are the typical front view of a common T-shirt. FIGS. 9, 10, 11, 13, 14 and 15 shows the common T-shirt with the DTSC attached. The belt-loop type feature of the DTSC is not shown on every figure as it would be in part 2 of FIGS. 3 and 6 and the other occurrences of part 2. It is shown on FIG. 3 as part 2*a*.

Figure 17:
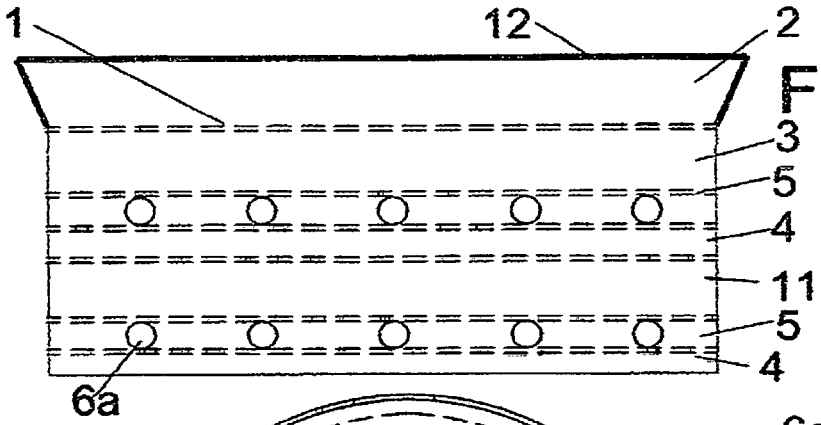
FIG. 17 is an elevation view of a flattened DTSC with magnets.
Figure 18:
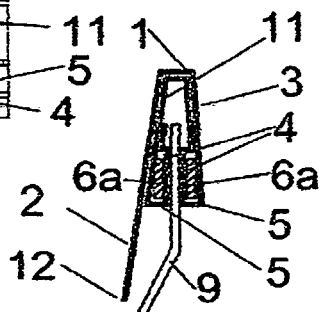
FIG. 18 is a cross-section view of a DTSC with magnets.
Figure 16:
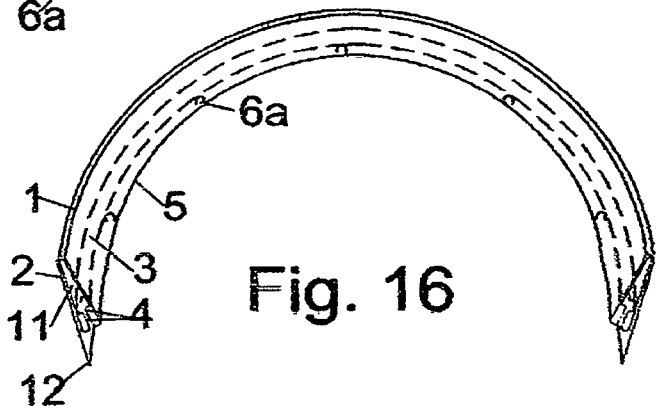
FIG. 16 is a perspective 3D view of a DTSC with magnets.
Figure 20:
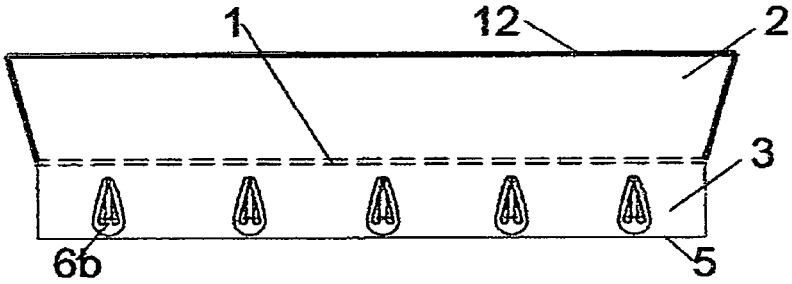
FIG. 20 is an elevation view of a flattened DTSC with clips.
Figure 19:
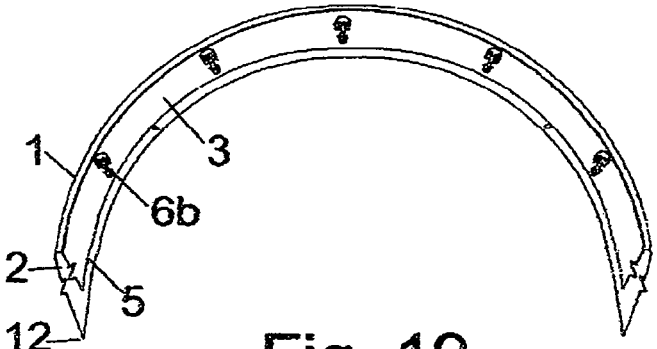
FIG. 19 is a perspective 3D view a DTSC with clips.
Figure 21:
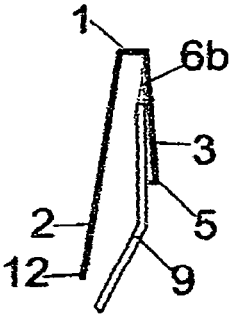
FIG. 21 is a cross-section view of a DISC with dips.

Similarly, FIGS. 18 and 21 show sectional views using magnets indicated as part 6*a* and clips indicated as part 6*b* to pair the DTSC with the T-shirt collar similarly described as a collarless garment FIGS. 17 and 20 show the flattened strip that is folded to contain the grouped magnets and the clips that dip-on and dip-off to the T-shirt collar. The feature part of the DTSC covers the connection to the T-shirt neck band. FIGS. 16 and 19 are 3D representations of the DTSC.

The Detachable T-shirt Collar similarly described as a collarless garment and is illustrated in FIGS. 9, 10, 13 and 14 is comprised of fabric material that is cut to a length as shown in FIGS. 3 and 6 and FIGS. 17 and 21 to provide a gap at the front of the T-shirt depending on the circumference of the T-shirt's collar band. Part 4 as shown in FIGS. 1, 4 and 7, and 18 and 21, is sized to match the T-shirt collar band. The height of the collar part 3 at the back as shown in FIGS. 1, 4, and 7 varies but is usually about an 25 mm (1") plus the height of the collar band and can have a tapered increase at the front towards the previously mentioned gap on either side to form the collar end as shown in FIGS. 9, 10, 13, and 14. The 2 piece fasteners are connected through the T-shirt collar band to the DISC as shown by part 6, 6*a* and 6*b* on FIGS. 1, 2, 3, 4, 5, 6, 7, and FIGS. 16,17, 18, 19, 20, and 21, with the 2 part pin or connector not coming in contact with the wearer's skin. Both parts of the 2-piece pin assembly are flat and grip each other for assembly and disassembly by separating them apart. When the magnet connector pair in 6*a* is used as shown on FIGS. 16, 17, and

18 or the clip in 6*b* is used, as shown on FIGS. 19, 20 and 21, they can be separated and joined together repeatedly. The fasteners joining 3 and 9 are concealed as shown in FIGS. 1, 4, 7, 18 and 21.

The embodiments of the invention in which an exclusive property and privilege is claimed are defined as follows:

1. A detachable collar adapted to be attached to a collarless garment, wherein the collar comprises a strip of material defining a longitudinal axis and having two fold lines extending generally parallel to the longitudinal axis and defining a plurality of panels comprising a first panel defining a collar leaf, a second panel attached to the first panel at a first fold line, the second panel defining a collar band, and a third panel attached to the second panel at a second fold line, wherein the third panel is adapted to be folded against the second panel and interposed between the second panel and an inside of a neck-band of the collarless garment and wherein the third panel receives fastening means for attaching the third panel to the neck-band of the collarless garment, said fastening means comprising a pin with an expanded face at one end, the expanded face being perpendicular to the pin, and a connecting cover at an opposite end of the pin that secures the pin end when it grips the pin end to secure it, the pin pierces through the third panel, with the expanded face or the connecting cover being interposed between the second panel and the third panel, and the other of the expanded face or the connecting cover being interposed between the neck-band and the first panel to secure the detachable collar to the neck-band, and the connecting cover can be released to allow connecting and reconnecting of the pin having the expanded face or connecting cover interposed between the second and third panels, such that said fastening means are isolated from the wearer's neck.

2. The detachable collar of claim 1, wherein the third panel is further folded at a third fold line to create a fourth panel, wherein the fourth panel is adapted to be folded over to overlay an outside of the neck-band of the collarless garment.

3. The detachable collar of claim 1 or 2 wherein an outermost surface of the collar exposed to viewing has two or more vertical strips attached to the outermost surface of the collar, said vertical strips adapted to accept and hold in place an elongated colored strip for decorative effect or for communications, or an elongated messaging strip displaying graphic designs for decorative effect or for communications, or an elongated photoluminescent strip for decorative effect or for visibility around the wearer of said collar.

* * * * *